US006170574B1

(12) United States Patent
Jones

(10) Patent No.: US 6,170,574 B1
(45) Date of Patent: Jan. 9, 2001

(54) METHOD OF FORMING CEMENT SEALS IN DOWNHOLE PIPES

(75) Inventor: Willroe C. Jones, Tulsa, OK (US)

(73) Assignee: Downhole Solutions, Inc., Tulsa, OK (US)

( * ) Notice: Under 35 U.S.C. 154(b), the term of this patent shall be extended for 0 days.

(21) Appl. No.: 09/231,565

(22) Filed: Jan. 14, 1999

(51) Int. Cl.[7] ..... E21B 39/13
(52) U.S. Cl. ..... 166/293; 106/819
(58) Field of Search ..... 166/292, 293; 106/819, 823

(56) References Cited

U.S. PATENT DOCUMENTS

| | | | | |
|---|---|---|---|---|
| 3,872,925 | | 3/1975 | Owen et al. | 166/286 |
| 3,954,677 | | 5/1976 | Law | 516/77 |
| 4,557,763 | | 12/1985 | George et al. | 106/706 |
| 4,674,574 | * | 6/1987 | Savoly et al. | 166/293 |
| 4,696,343 | | 9/1987 | Anderson et al. | 166/164 |
| 4,739,829 | | 4/1988 | Brunner | 166/63 |
| 4,791,989 | | 12/1988 | Brothers et al. | 166/293 |
| 4,818,288 | * | 4/1989 | Aignesberger et al. | 106/819 |
| 5,033,549 | | 7/1991 | Champeaux et al. | 166/278 |
| 5,046,562 | * | 9/1991 | Crema et al. | 166/293 |
| 5,092,935 | * | 3/1992 | Crema et al. | 166/293 |
| 5,105,885 | | 4/1992 | Bray et al. | 166/279 |
| 5,115,860 | | 5/1992 | Champeaux et al. | 166/51 |
| 5,314,023 | | 5/1994 | Dartez et al. | 166/295 |
| 5,355,955 | | 10/1994 | Rodrigues et al. | 166/293 |
| 5,379,840 | * | 1/1995 | Cowan et al. | 166/292 |
| 5,421,879 | | 6/1995 | Rodrigues | 106/727 |
| 5,447,197 | * | 9/1995 | Rae et al. | 166/293 |
| 5,472,051 | | 12/1995 | Brothers | 166/293 |
| 5,536,311 | | 7/1996 | Rodrigues | 106/724 |

* cited by examiner

*Primary Examiner*—Eileen D. Lillis
*Assistant Examiner*—John Kreck
(74) *Attorney, Agent, or Firm*—Browning Bushman

(57) ABSTRACT

A method of forming a seal in a downhole pipe comprising positioning a dump bailer containing a predetermined amount of a cement slurry at a desired location in a pipe disposed downhole in an earth borehole, displacing the cement slurry from the dump bailer, and allowing the cement slurry to set and form a seal, wherein the cement slurry comprises a pumpable slurry containing a hydraulic cement; water; a water-soluble salt of a metal selected from the class consisting of alkali metals, alkaline earth metals, zinc, and mixtures thereof; a dispersant comprising an anionic surface-active agent of the sulfonated naphthlalene; and magnesium chloride.

7 Claims, No Drawings

METHOD OF FORMING CEMENT SEALS IN DOWNHOLE PIPES

BACKGROUND OF THE INVENTION

1. Field of the Invention

The present invention relates to a method for downhole cementing and, more particularly, to a method for forming a seal or plug of cement in a pipe disposed in an earth borehole, such as an oil well gas, gas well, water well, or the like.

2. Description of the Prior Art

It is well known in the oil well drilling and production arts to use cement for various well operations, such as, for example, to seal off a certain formation below a production packer so that other producing zones can be perforated. In still other cases, to maintain peak production and/or manage the reservoir, oil and gas wells are commonly subjected to maintenance operations referred to in the industry as "workovers." It is common in workovers to emplace temporary or permanent plugs at strategic places in the well to isolate specific areas of the well for servicing. Commonly, this involves the use of mechanical devices known as bridge plugs or retainers that are wedged or mechanically positioned into position into the pipe, e.g., casing or tubing, to form a seal that prevents the flow of fluids below the plug from traveling up the pipe and, conversely, prevents fluids above the pipe from flowing deeper into the well. In most cases, to obtain the required degree of sealing, a cement slurry is placed on top of the bridge plug or retainer, although in certain cases, the cement slurry can be deposited in the well at the desired location, the seal or plug being formed upon expansion and setting of the cement without the use of a mechanical bridge plug, retainer, or the like.

Regardless of whether a bridge plug, retainer, or the like is employed, in workover or similar operations where it is desired to form a cement seal or plug in a pipe, such as tubing or casing, the cement slurry is delivered to the desired location in the pipe by means of a dump bailer, which is well know in the art. Examples of suitable dump bailers are shown in U.S. Pat. Nos. 4,739,829; 4,696,343; 3,872,925; and 5,033,549, all of which are incorporated herein by reference for all purposes.

One problem encountered in the use of dump bailers involves the nature of the cement slurry carried by the dump bailer. Severe problems, including complete job failure or destruction of the dump bailer can develop if the cement slurry becomes too viscous to be expelled from the bailer, or if the slurry does not stay uniform and undergoes settling as the slurry is transferred from the wellhead down the pipe. Still other problems can occur if the cement slurry is incompatible and becomes dispersed with the host fluid in the well, such as, for example, a heavy brine such as a zinc bromide brine. Such incompatibility between the cement slurry and the host fluid can result in gellation of the slurry, preventing the total volume in the bailer from dumping. In this case, the slurry remaining in the bailer would set, rendering the dump bailer useless. Additionally, this intermingling of the cement slurry and an inhospitable host fluid can reduce the shear bond strength of the seal or plug, resulting in seal failure; a longer setting time, increasing the chances of failure to seal; or the inability of the slurry to set at all. Still other problems may occur if the host fluid and cement slurry intermingle and the resulting mixture has a specific gravity that is less than that of the host fluid, which typically results in the resulting mixture containing its cement slurry mass floating up the pipe. All of the above adverse circumstances can result in complete job failure.

In attempts to overcome the above problems, cement slurries are tailored with various chemicals that viscosify and prevent settling, even under higher temperatures, which tend to thin the slurry. Additionally, in certain cases other chemical agents to retard or prevent premature setting are employed. In general, these tailored slurries are often very difficult to mix on the surface (requiring as much as 15–20 minutes to form into uniform slurries).

Accordingly, there exists the need for a method of forming a cement plug or seal in a pipe disposed in an earth borehole that can employ a dump bailer and that utilizes a cement slurry that overcomes many of the prior art problems discussed above with respect to the use of dump bailers and methods for forming cement plugs or seals. In particular, there exists a need for a cement slurry that can be used with a dump bailer cementing technique wherein the cement slurry is compatible with the host fluid.

SUMMARY OF THE INVENTION

It is therefore an object of the present invention to provide a method for forming a cement seal or plug in a pipe disposed in an earth borehole, such as oil, gas, or water well.

Still another object of the present invention is to provide a method for forming a cement seal or plug in a pipe disposed in an earth borehole that employs a dump bailer and a cement slurry that is substantially unaffected by inhospitable host fluids present in the borehole.

In accordance with the present invention, there is provided a method of forming a cement seal or plug in a pipe disposed in an earth borehole comprising positioning a dump bailer containing a predetermined amount of cement slurry at a preselected location in a pipe disposed in an earth borehole, displacing the cement slurry from the dump bailer at the preselected location, and permitting the cement slurry to set to form a cement plug or seal and wherein the cement slurry comprises a hydraulic cement, water, an alkali or alkaline earth metal halide salt, a dispersant comprising an anionic surface-active agent of the sulfonated naphthalene type, and magnesium chloride. Optionally, the cement slurry can contain a silica material, such as sodium silicate, to prevent strength retrogression and, if necessary, a cement set retarding additive to permit premature setting of the cement slurry.

DESCRIPTION OF THE PREFERRED EMBODIMENTS

According to the method of the present invention, a dump bailer is used to deliver a predetermined amount of a cement slurry to a predetermined location in a pipe disposed in an earth borehole, the cement slurry being expelled or released from the dump bailer at the predetermined location, after which the dump bailer is removed from the well, the cement slurry being allowed to set at the predetermined location to form a seal or plug. As is well known to those skilled in the art of downhole cementing operations, any dump bailer can be employed in the method of the present invention. Non-limiting examples of such dump bailers are disclosed in the patents referred to above, all of which are incorporated herein by reference for all purposes. The cement slurry that is used in the method of the present invention is easy to mix; is completely slurried in about 3 minutes; does not settle; retains its integrity when discharged from the dump bailer, i.e., it resists admixing with the host fluids in the well; and is generally compatible with host fluids found in the well.

The cement slurry of the present invention generally comprises a hydraulic cement, water, a compatibilizing agent in the form of a suitable metal, such as a water soluble salt of an alkali or alkaline earth metal, a dispersant, and, optionally, a retarder and/or a silica material to strengthen the dispersive characteristics of the slurries.

While various hydraulic cements can be utilized in forming the cement slurries of the present invention, Portland cement is preferred and can be, for example, one or more of the various types identified as API Classes A-H. These cements are identified and defined in "API Specifications for Material and Testing for Well Cements," *API Specs* 10*A*, 21st Ed., Sep. 1, 1991, American Petroleum Institute, which is incorporated herein by reference. As stated in *API Specs* 10*A*, the well cements A–H have the following characteristics:

Class A: The product obtained by grinding Portland cement clinker, consisting essentially of hydraulic calcium silicates, usually containing one or more of the forms of calcium sulfate as an interground addition. At the option of the manufacturer, processing additions[1] may be used in the manufacture of the cement, provided such materials in the amounts used have been shown to meet the requirements of ASTM C 465. This product is intended for use when special properties are not required. Available only in ordinary (O) Grade (similar to ASTM C 150, Type I).

A suitable processing addition or set-modifying agent shall not prevent a well cement from performing its intended functions.

Class B: The product obtained by grinding Portland cement clinker, consisting essentially of hydraulic calcium silicates, usually containing one or more of the forms of calcium sulfate as an interground addition. At the option of the manufacturer, processing additions[1] may be used in the manufacture of the cement, provided such materials in the amounts used have been shown to meet the requirements of ASTM C 465. This product is intended for use when conditions require moderate or high sulfate resistance. Available in both moderate sulfate-resistant (MSR) and high sulfate-resistant (HSR) Grades (similar to ASTM C 150, Type II).

A suitable processing addition or set-modifying agent shall not prevent a well cement from performing its intended functions.

Class C: The product obtained by grinding Portland cement clinker, consisting essentially of hydraulic calcium silicates, usually containing one or more of the forms of calcium sulfate as an interground addition. At the option of the manufacturer, processing additions[1] may be used in the manufacture of the cement, provided such materials in the amounts used have been shown to meet the requirements of ASTM C 465. This product is intended for use when conditions require high early strength. Available in ordinary (O), moderate sulfate-resistant (MSR) and high sulfate-resistant (HSR) Grades (similar to ASTM C 150, Type III).

A suitable processing addition or set-modifying agent shall not prevent a well cement from performing its intended functions.

Class D: The product obtained by grinding Portland cement clinker, consisting essentially of hydraulic calcium silicates, usually containing one or more of the forms of calcium sulfate as an interground addition. At the option of the manufacturer, processing additions[1] may be used in the manufacture of the cement, provided such materials in the amounts used have been shown to meet the requirements of ASTM C 465. Further, at the option of the manufacturer, suitable set-modifying agents[1] may be interground or blended during manufacture. This product is intended for use under conditions of moderately high temperatures and pressures. Available in moderate sulfate-resistant (MSR) and high sulfate-resistant (HSR) Grades.

A suitable addition or set-modifying agent shall not prevent a well cement from performing its intended functions. p1 Class E: The product obtained by grinding Portland cement clinker, consisting essentially of hydraulic calcium silicates, usually containing one or more of the forms of calcium sulfate as an interground addition. At the option of the manufacturer, processing additions[1] may be used in the manufacture of the cement, provided such materials in the amounts used have been shown to meet the requirements of ASTM C 465. Further, at the option of the manufacturer, suitable set-modifying agents[1] may be interground or blended during manufacture. This product is intended for use under conditions of high temperatures and pressures. Available in moderate sulfate-resistant (MSR) and high sulfate-resistant (HSR) Grades.

A suitable addition or set-modifying agent shall not prevent a well cement from performing its intended functions.

Class F: The product obtained by grinding Portland cement clinker, consisting essentially of hydraulic calcium silicates, usually containing one or more of the forms of calcium sulfate as an interground addition. At the option of the manufacturer, processing additions[1] may be used in the manufacture of the cement, provided such materials in the amounts used have been shown to meet the requirements of ASTM C 465. Further, at the option of the manufacturer, suitable set-modifying agents[1] may be interground or blended during manufacture. This product is intended for use under conditions of extremely high temperatures and pressures. Available in moderate sulfate-resistant (MSR) and high sulfate-resistant (HSR) Grades.

A suitable addition or set-modifying agent shall not prevent a well cement from performing its intended functions.

Class G: The product obtained by grinding Portland cement clinker, consisting essentially of hydraulic calcium silicates, usually containing one or more of the forms of calcium sulfate as an interground addition. No additions other than calcium sulfate or water, or both, shall be interground or blended with clinker during manufacture of Class G well cement. This product is intended for use as a basic well cement. Available in moderate sulfate-resistant (MSR) and high sulfate-resistant (HSR) Grades.

Class H: The product obtained by grinding Portland cement clinker, consisting essentially of hydraulic calcium silicates, usually containing one or more of the forms of calcium sulfate as an interground addition. No additions other than calcium sulfate or water, or both, shall be interground or blended with the clinker during manufacture of Class H well cement. This product is intended for use as a basic well cement. Available in moderate sulfate-resistant (MSR) and high sulfate-resistant (HSR) Grades. API Portland cements generally have a maximum particle size of about 90 microns and a specific surface (sometimes referred to as Blaine Fineness) of about 3900 $cm^2/gm$. A highly useful and effective cement for use in the cement slurry of the present invention comprises API Class H Portland cement mixed with water and the other additives to provide a slurry having a density of from about 11.3 to about 18.0 lbs/gal. In certain cases, small particle size hydraulic cements consisting of particles having diameters no larger than about 30 microns and a Blaine Fineness of no less than about 6000 $cm^2/gm$ can be employed. The water used in the cement slurries of the present invention can be water from any source, provided that it does not contain an excess of compounds that adversely react with or otherwise affect other components in the cement slurry. The water is present in an amount sufficient to form a slurry of the cement, preferably a slurry that is readily pumpable. Generally, the water is present in an amount of from about 20 to about 55% by weight of dry cement in the composition.

A compatibilizing agent in the form of a water soluble salt of a metal such as zinc or an alkaline earth or alkali metal, preferably a halide of such a metal, is incorporated into the cement slurry in an amount of from about 5 to about 35% based on the amount of water present in the slurry. Thus, the metal salt can be calcium chloride, potassium chloride, zinc chloride, or the like. Preferably, the compatibilizing agent is a salt that possesses greatest compatibility with the host fluid.

The cement slurry used in the method of the present invention also contains a dispersant in the form of an anionic surface-active agent of the sulfonated naphthalene type in admixture with magnesium chloride. In particular, the sulfonated naphthalene materials used in the present invention are sulfonated aromatic-formaldehyde condensation products such as disclosed in U.S. Pat. No. 3,954,677, incorporated herein by reference for all purposes. One such sulfonated aromatic-formaldehyde condensation product is available under the trademark LOMAR-D, well known to those in the industry.

In forming the cement slurry of the present invention, the dispersant is added in the form of a water solution (aqueous dispersant) containing the sodium salt of the sulfonated aromatic-formaldehyde condensation product and magnesium chloride. The sulfonated aromatic-formaldehyde condensation product will be present in the aqueous dispersant in an amount of from about 88 to about 95% by weight based on the weight of water in the aqueous dispersant, the magnesium chloride being present in an amount of from about 8 to about 10% by weight of the water present in the aqueous dispersant. Generally, aqueous dispersant will be added in an amount of from about 0.2 to about 2 gallons per 94 lbs. of dry cement present in the slurry.

In addition to the above components, the cement slurry of the present invention can contain a silica material, preferably sodium silicate, the silica material generally being present in an amount of from about 20 to about 40% of dry cement, the silica material preferably being in the form of finely ground sand, commonly referred to in the industry as cement silica.

Depending upon the composition of the host fluids present in the well, bottom hole static temperatures, and other such variables, it may be desirable to also incorporate a cement set retarding agent (set retardant) into the cement slurry. Such set retardants are well known to those skilled in the art and include materials such as cellulose derivatives and calcium lignosulfonates, as well as other types of lignosulfonates and set retardants, disclosed in U.S. Pat. Nos. 5,355,955; 5,421,879; 5,536,311; and 5,472,051, all of which are incorporated herein by reference for all purposes. A preferred set retardant is a glucoside derivative, particularly a calcium glucoheptonate, marketed as Sequelene ES-40 by Pfanstiehl Laboratories, Inc. When employed, the set retardant will be included in the cement slurry in an amount sufficient to delay or retard the setting of the cement slurry for the time period required to place the cement slurry in the predetermined location. It is well known that the thickening and set times of cement compositions (slurries) of the present type are strongly dependent upon temperature and pressure, as well as the nature of the host fluid. Accordingly, in practicing the method of the present invention, the quantity of set retardant to be employed will be determined in advance by performing thickening time tests, as described in the above-mentioned *API Specification* 10*A*, taking into account bottom hole static temperatures; the nature of the host fluid, if any, in the well; the time for the cement slurry to be delivered to the predetermined location in the well; etc. In general, and when employed, the set retardant will be present in the cement slurry in an amount of from about 0.1 to about 5% by weight of dry cement in the cement slurry. In the case of the preferred Sequelene ES-40, which is generally marketed as a water solution containing 20 to 60% by weight of calcium glucoheptonate, up to 2.5 gallons of the Sequelene ES-40 water solution per 94 lbs. of dry cement in the cement slurry can be employed.

To form the cement slurry used in the method of the present invention, the ingredients are mixed together to form a pumpable slurry, which is then loaded, in the desired amount, into the dump bailer. The dump bailer is then lowered into the pipe by means of a wireline or the like to the desired location, e.g., generally above a bridge plug retainer or the like, and the cement slurry is then released from the dump bailer. The dump bailer is then removed from the pipe and the cement slurry allowed to set to form a cement seal or plug.

Listed below is the composition of a cement slurry for use in the method of the present invention that has been found to avoid most prior art problems encountered when using dump bailers in methods for emplacing concrete seals or plugs in pipe in earth boreholes:

1. API Class H cement;
2. 35% by weight sodium silicate flour based on the weight of dry cement
3. 0.6 gal/94 lbs of dry cement of an aqueous dispersant containing water, 88–95% by weight based on the water content in the aqueous dispersant of the sodium salt of a sulfonated aromatic-formaldehyde condensation product and 8–10% by weight based on the water in the aqueous dispersant of $MgCl_2$;
4. 20–55% by weight water;
5. 5–40% by weight based on the weight of water in the slurry of sodium chloride;
6. A set retardant in an amount sufficient to regulate the setting time of the cement slurry when the Bottom Hole Static Temperature (BHST) exceeds 175° F. In wells having a BHST of 250° F. or greater, the composition usually includes 1 gal/94 lbs of dry cement Sequelene ES-40. At temperatures in excess of 250° F., more set retardant may be necessary. However, as noted, at BHSTs of less than 175° F., generally no set retardant is required in the composition.

A particular feature of the method of the present invention is that the dispersant employed in the cement slurry allows a wide variation in the amount of water, which is necessary to maintain a pumpable slurry and ensure that the specific gravity of the cement slurry can be adjusted so as to be greater than that of the host fluid. This is important since the host fluid encountered in the well may be of relatively high density, e.g., 15 lbs./gal, meaning that it would be necessary to reduce the amount of water and increase the amount of dry cement in the slurry in order to provide a cement slurry having a specific gravity greater than the host fluid. The particular dispersant employed thus permits wide variations in the water content, thus making the method of the present invention versatile and useful in wells having widely varying characteristics, e.g., nature of the host liquid fluid, temperature, etc.

What is claimed is:

1. A method of forming a seal or plug in a downhole pipe comprising:

positioning a dump bailer containing a predetermined amount of a cement slurry at a desired location in a pipe disposed downhole in an earth borehole;

displacing said cement slurry from said dump bailer; and allowing said cement slurry to set and form said seal wherein said cement slurry comprises a pumpable slurry comprising a hydraulic cement, water, a water soluble salt of a metal selected from the class consisting of alkali metals, alkaline earth metals, zinc, and mixtures thereof, a dispersant comprising an anionic surface-active agent of the sulfonated naphthalene type, and magnesium chloride, said dispersant being in the form of an aqueous solution, said dispersant being present in said aqueous solution in an amount of from 88 to 95% by weight based on the weight of water in the aqueous solution, said aqueous solution being present in an amount of from 0.2 to 2 gallons per 94 lbs. of dry cement present in the slurry.

2. The method of claim 1 wherein said water-soluble salt is present in an amount of from 5 to 35% by weight based on the amount of water present in the slurry.

3. The method of claim 1 wherein said magnesium chloride is present in said aqueous solution in an amount of from 8 to 10% by weight of the water present in the aqueous solution.

4. The method of claim 1 wherein a silica material is present in said slurry in an amount of from 20 to 40% of the amount of dry cement present in the slurry.

5. The method of claim 1 wherein a set retardant is present in said cement slurry.

6. The method of claim 5 wherein said set retardant comprises calcium glucoheptonate.

7. The method of claim 5 wherein said set retardant is present in an amount of from 0.1 to 5% by weight of the dry cement present in the cement slurry.

* * * * *